US009033607B2

(12) United States Patent
Malaguti

(10) Patent No.: US 9,033,607 B2
(45) Date of Patent: May 19, 2015

(54) FOUNTAIN PEN

(76) Inventor: Gian Luca Malaguti, Monaco (MC)

( * ) Notice: Subject to any disclaimer, the term of this patent is extended or adjusted under 35 U.S.C. 154(b) by 306 days.

(21) Appl. No.: 13/574,319

(22) PCT Filed: Jan. 25, 2011

(86) PCT No.: PCT/IB2011/050319

§ 371 (c)(1),
(2), (4) Date: Jul. 20, 2012

(87) PCT Pub. No.: WO2011/092624

PCT Pub. Date: Aug. 4, 2011

(65) Prior Publication Data

US 2012/0294668 A1 Nov. 22, 2012

(30) Foreign Application Priority Data

Jan. 28, 2010 (IT) ..... BO2010A0052
Jan. 28, 2010 (IT) ..... BO2010A0053

(51) Int. Cl.
*B43K 5/18* (2006.01)
*B43K 5/04* (2006.01)
*B43K 5/14* (2006.01)

(52) U.S. Cl.
CPC ... *B43K 5/04* (2013.01); *B43K 5/14* (2013.01); *B43K 5/1809* (2013.01); *B43K 5/1827* (2013.01)

(58) Field of Classification Search
USPC ..... 401/152–157, 222–226, 232, 234, 243
See application file for complete search history.

(56) References Cited

U.S. PATENT DOCUMENTS

| | | | | |
|---|---|---|---|---|
| 2,303,374 | A | 12/1942 | Martin | |
| 2,340,359 | A | 2/1944 | Ziegler | |
| 2,802,449 | A * | 8/1957 | Martin | 401/157 |
| 6,536,976 | B1 * | 3/2003 | Konose | 401/198 |
| 7,384,208 | B2 * | 6/2008 | Bouix et al. | 401/269 |

FOREIGN PATENT DOCUMENTS

| | | | |
|---|---|---|---|
| CN | 2700121 | Y | 5/2005 |
| CN | 1727187 | A | 2/2006 |
| CN | 201042887 | Y | 4/2008 |
| JP | H6-17577 | | 5/1994 |
| JP | 2002240477 | A | 8/2002 |
| WO | 2009/141747 | | 11/2009 |

OTHER PUBLICATIONS

International Search Report dated Apr. 15, 2011 from counterpart application.

* cited by examiner

*Primary Examiner* — David Walczak
(74) *Attorney, Agent, or Firm* — Timothy J. Klima; Shuttleworth & Ingersoll, PLC

(57) ABSTRACT

A fountain pen comprises a hollow barrel such as can be held by a user, a nib stably attached to one end of the hollow barrel, also an ink cartridge housed internally of the hollow barrel and having a given containment volume. The cartridge is connected to the nib by way of a feed through which ink flows to the nib, and deformable by expanding at least partially between a normally undeformed first configuration, and a deformed second configuration in which the containment volume created internally is greater than the containment volume in the undeformed configuration.

21 Claims, 6 Drawing Sheets

Fig.3.1

FOUNTAIN PEN

This application is the National Phase of International Application PCT/IB2011/050319 filed Jan. 25, 2011 which designated the U.S. and that International Application was published under PCT Article 21(2) in English.

This application claims priority to Italian Patent Application No. BO2010A000052 filed Jan. 28, 2010, Italian Patent Application No. BO2010A000053 dated Jan. 28, 2010, and PCT Application No. PCT/IB2011/050319 filed Jan. 25, 2011, which applications are incorporated by reference herein.

TECHNICAL FIELD

The present invention relates to a fountain pen.

A fountain pen typically comprises a hollow barrel that functions as the outer casing of the pen and houses a reservoir (consisting in a cavity, or a cartridge) containing ink; the barrel also provides the grippable portion of the pen that is held by a user when writing. Attached to one end of the hollow barrel is a nib, constituting the part of the pen through which the ink is delivered when writing, and connected for this purpose to the ink reservoir by an element known to persons skilled in the art as a feed.

The nib presents a writing tip and rests flush on the feed, which is furnished with one or more ducts conveying the ink from the reservoir to the tip by capillary action.

BACKGROUND ART

By reason of their structure, fountain pens of conventional design are inevitably liable to leak appreciable amounts of ink when exposed to fluctuations in temperature or pressure.

In the main, ink leaks may be caused as a result of the pen barrel being warmed by the hand of the user when writing, and during air travel, as a consequence of pressure dropping in the aircraft cabin. In either case, a difference in pressure is created between the inside of the reservoir (or cartridge) and the outside, sufficient to overcome the resistance of the ducts in the nib and cause the ink to escape.

In effect, the force exerted on the ink is due to the pressure of the gas (typically air) locked in the cartridge being greater than that of the surrounding environment, and will tend to continue expelling the ink until such time as the pressure of this same gas and the pressure externally of the cartridge have equalized.

With regard in particular to a drop in ambient pressure, it has been found that the problem persists even when adopting a hermetic cap, since the moment the cap is removed, the ink will in any event escape and leave self-evidently unwelcome stains, often indelible. In this situation, consequently, the fountain pen becomes unusable at least temporarily, until the cause of the variation in temperature and/or pressure disappears.

According to U.S. Pat. No. 2,340,359 (Ziegler) in a pen with an elastically compressibile sac structure as reservoir for the ink to avoid the expulsion of ink in case of changes in atmospheric pressure it suggested that the sac is equipped with a shrounding which is formed of one or more strands of filament wound closely about the sac, so to realize a net, such strand or filament being not extensible so to avoid any dilatation of the sac in case of changes in atmospheric pressure.

It has been found that the said solution is difficult to be realized in practice considering what it is described in the specification at page 2.

According to WO 2009/141747 it is provided a fountain pen with a refillable ink reservoir deformable between a first limit position with maximum internal volume and a second position with reduced internal volume and subject to the actions of a mechanism to create a vacuum inside the ink reservoir by compressing and decompressing the ink reservoir in view to consent the refilling of ink inside the reservoir. The fountain pen is equipped with a cap for covering the nib of the pen, when the pen is not being used, and it is equipped also with valve means provided to close the channel of passage of the ink from the reservoir and the nib with the cap in a position to cover the nib, so to avoid the expulsion of ink in case of changes in atmospheric pressure.

It has been found that in case of changes in atmospheric pressure when the cup is later removed the risk that a minimum flow of ink is expelled from the nib cannot be avoided due the structure of the ink compressing reservoir.

AIM OF THE INVENTION

Accordingly, the object of the present invention is to provide a fountain pen such as will be unaffected by the drawbacks associated with the prior art mentioned above.

One object of the present invention, in particular, is to provide a fountain pen that will withstand fluctuations in temperature and/or pressure without ink leaking from the nib.

A further object of the invention is to provide a fountain pen that can be used at all times, and in particular, even during or immediately following the onset of conditions tending to cause the aforementioned fluctuations in temperature and/or pressure.

The stated objects of the invention are substantially realized in a fountain pen of which the characteristics are as recited in one or more of the appended claims.

BRIEF DESCRIPTION OF THE DRAWINGS

The invention will now be described in detail, by way of example, with the aid of the accompanying drawings, in which:

FIG. 3.1 is lateral view of the ink cartridge of FIG. 3;

DETAILED DESCRIPTION OF THE PREFERRED EMBODIMENTS OF THE INVENTION

Figure 1:
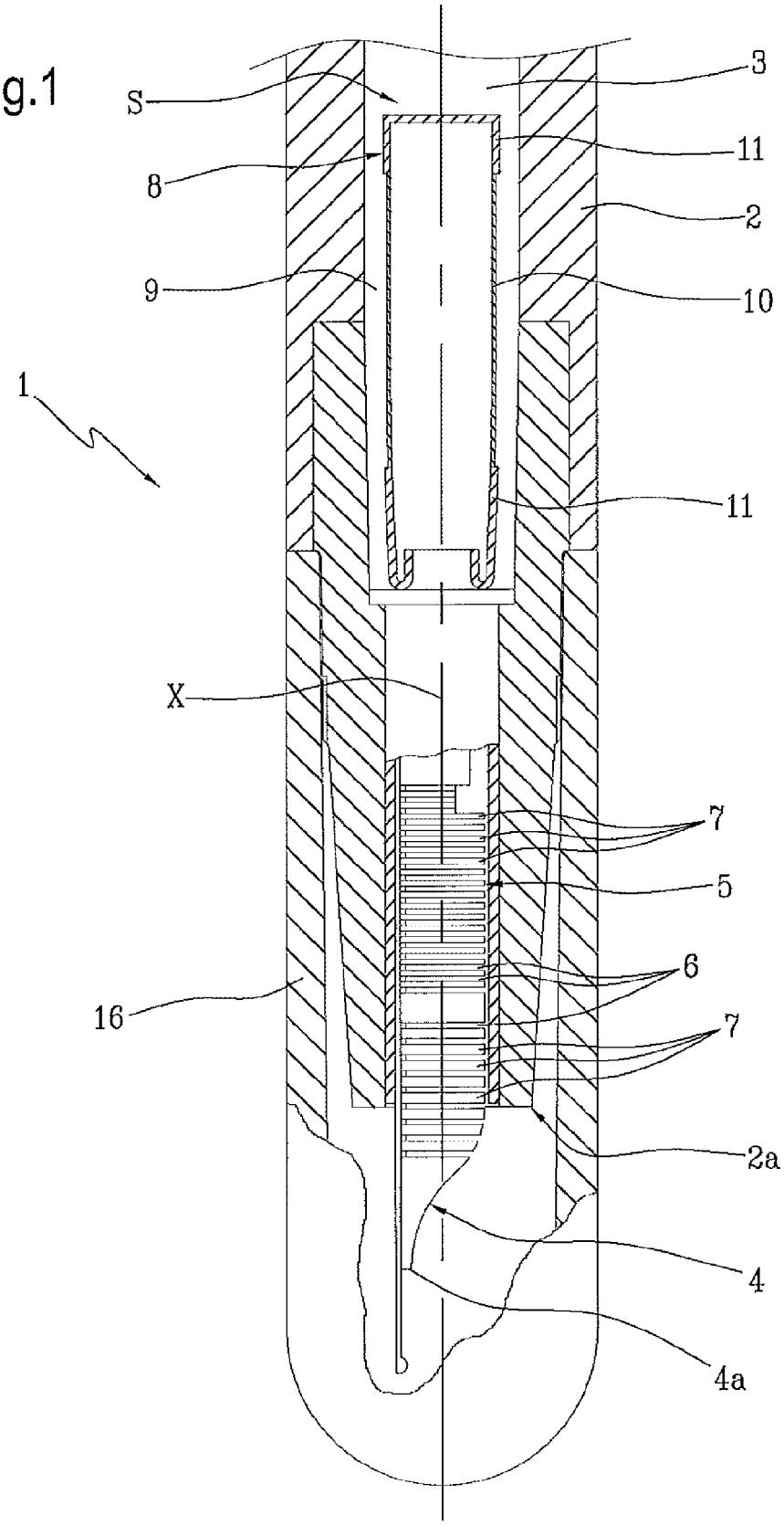
FIG. 1 shows a portion of a fountain pen according to the present invention, seen in a part elevation and part sectional view taken on a longitudinal plane and illustrated in a first operating configuration.

With reference to the accompanying drawings, numeral 1 denotes a fountain pen, in its entirety, according to the present invention.

The pen 1 comprises a hollow barrel 2 by which the pen is held when writing, and which provides an outer casing.

The barrel 2 has a predominating longitudinal axis denoted X and extends along this same axis X from a front end 2*a*, the writing end of the pen, and a rear end not visible in the accompanying drawings.

The inside of the barrel 2 presents a chamber 3 extending longitudinally along the axis X and designed to contain a reservoir S of ink.

Attached stably to the hollow barrel 2 at the aforementioned front end 2*a* is a nib 4, presenting a writing tip 4*a* designed to release ink when offered to the writing surface, and accordingly, positioned outside the dimensional compass of the barrel 2, projecting from the front end.

At the end remote from the writing tip 4*a*, the nib 4 presents an ink feed element 5 directed toward the reservoir S, embodied preferably in one piece with the tip 4*a*. The ink feed element 5 presents a plurality of ink-retaining chambers 6 delimited one from another by a sequence of partition walls 7 disposed mutually parallel and perpendicular to the longitudinal axis X, such as can be filled by the ink when delivered from the reservoir S at a high rate of flow. This situation will be illustrated in due course.

Thus, the ink-retaining chambers 6 take the form substantially of interstices delimited by adjacent partition walls 7.

The feed element 5, fashioned for example from plastic material by an injection process, presents an internal duct (not illustrated) aligned on the aforementioned longitudinal axis X and connecting the selfsame feed element 5 to the writing tip 4*a*; the duct will also be connected preferably to the retaining chambers 6 in such a manner that when ink is delivered from the reservoir S at a high rate of flow, as aforementioned, the excess can be released to the chambers.

In other words, the ink feed element 5 is located between the reservoir S and the writing tip 4*a* of the nib 4, serving thus to regulate the flow of ink and prevent the nib from flooding.

For instance, an excessive flow of ink would tend to occur when the difference in pressure levels on the inside and the outside of the reservoir S results in a significant force being generated from the inside of the reservoir outwards (due to a rise in internal pressure, induced for example by heat from the hand of the user when holding the pen), or when ink is drawn to excess from the reservoir by an external force (such as negative external pressure, generated for example during air travel by a pressure drop in the aircraft cabin).

To advantage, the fountain pen 1 according to the present invention comprises a reservoir S of which the internal volume can be increased to accommodate a variation in pressure and thereby counteract the condition that otherwise would quickly cause an abnormally and undesirably copious release of ink from the reservoir S.

In particular, the reservoir S is deformable between a normally undeformed first configuration (illustrated in FIG. 1), and a deformed second configuration (illustrated in FIG. 2) in which its containment volume is greater than the containment volume afforded in the undeformed configuration.

The increase in volume is determined by the difference in pressure levels existing inside and outside the reservoir S, hence on either side of the reservoir walls. These unequal pressures induce a deformation that causes the reservoir S to expand, with the result that the containment volume is increased. Accordingly, the change in pressure is absorbed by the deformation of the reservoir S and by the consequent increase in its containment volume, thus attenuating the force exerted on the ink, which tends to remain within the reservoir S.

At all events, any release of ink that may occur will be minimal, and taken up by the retaining chambers 6 of the feed element 5, so that there is no leakage of ink from the pen 1.

Figure 2:
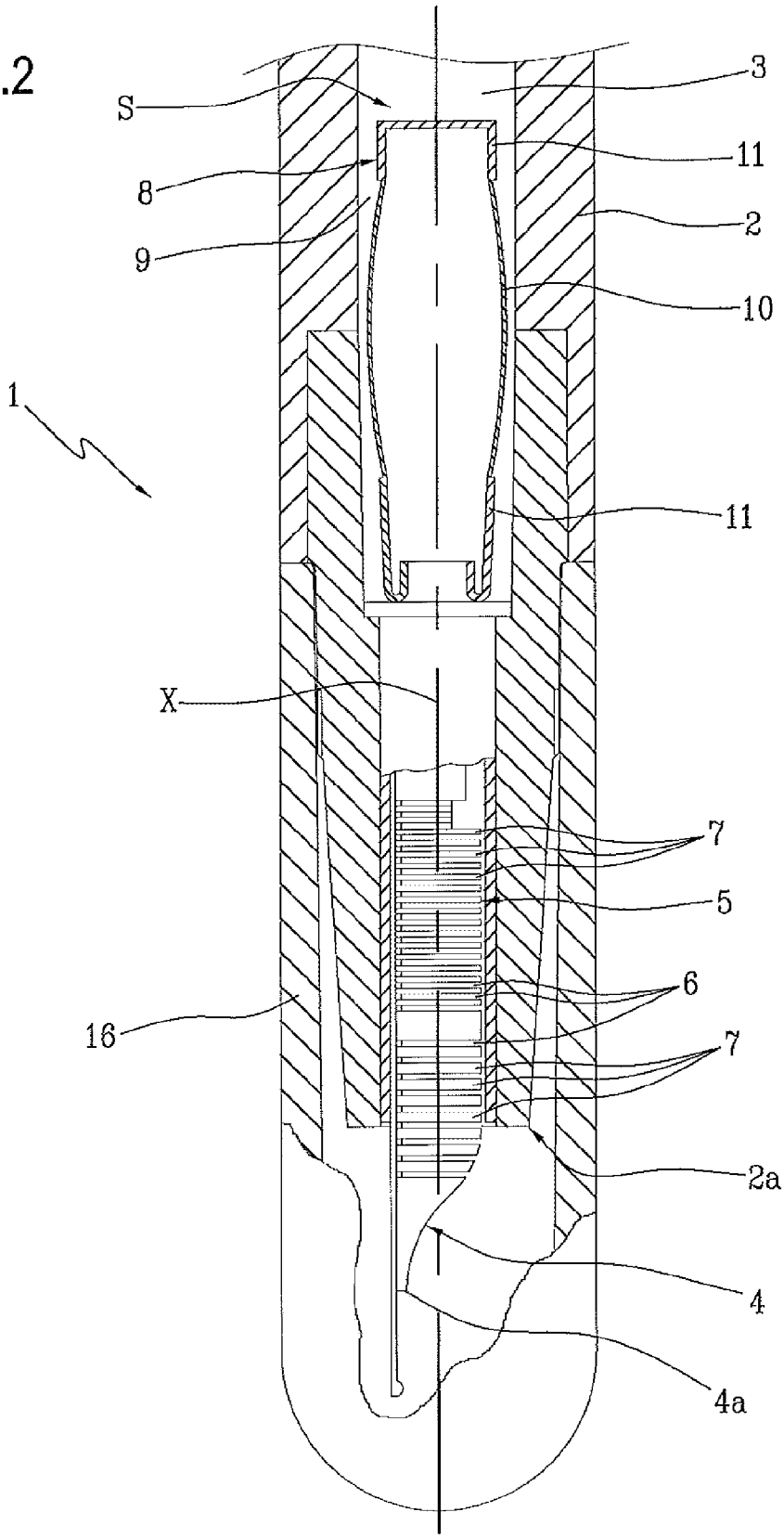
FIG. 2 shows the portion of the fountain pen in FIG. 1, seen in a part elevation and part sectional view taken on a longitudinal plane and illustrated in a second operating configuration.
Figure 3:
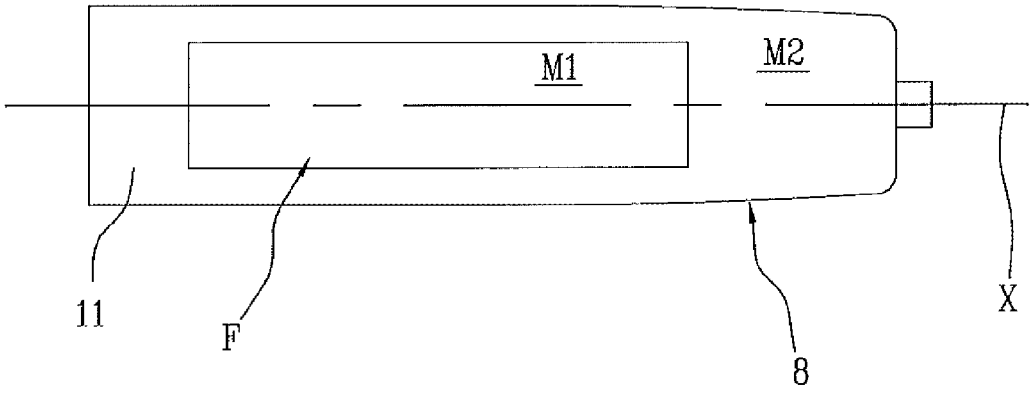
FIG. 3 is a side view of an ink cartridge used in the fountain pen embodied according to the invention and illustrated in FIGS. 1 and 2.
Figure 3:
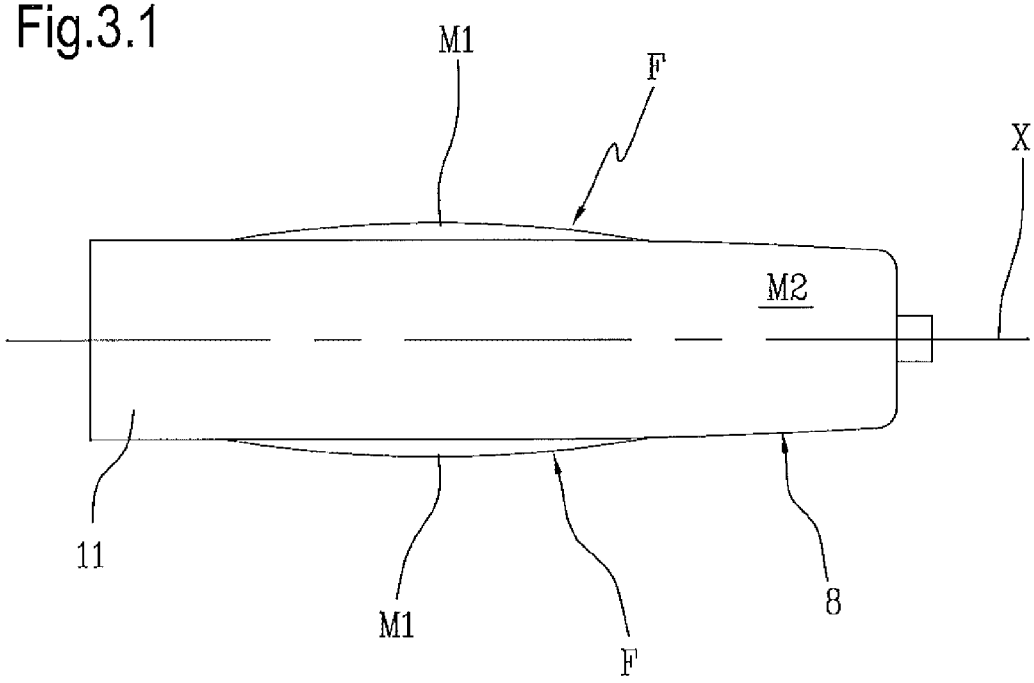

With reference to FIGS. 1, 2 and 3, the ink reservoir takes the form of a cartridge 8 housed stably within the hollow barrel 2 (and preferably removable), aligned on the longitudinal axis X.

The reservoir S, realized in the form of a cartridge 8, is positioned in the hollow barrel 2 in such a way as to create an annular air chamber 9, between the cartridge and the barrel, of width measuring between 0.5 to 3 millimeters and preferably between 1 to 3 millimeters.

The cartridge 8 is shaped preferably in such a way that the transition from the normally undeformed configuration to the deformed configuration occurs through lateral expansion, that is to say bulging in a transverse direction, away from the longitudinal axis X. The expansion is allowed by the aforementioned width values adopted for the annular air chamber 9 separating the cartridge 8 from the barrel 2.

The deformability of the cartridge 8 is elastic in nature. Accordingly, once the cartridge 8 has assumed the expanded (deformed) configuration, it will tend to return to the initial undeformed configuration spontaneously.

FIG. 3 illustrates the cartridge 8 in detail. The cartridge 8 presents at least one first portion 10 fashioned from a first elastically deformable material, capable of deforming elastically between the normally undeformed configuration and the deformed configuration.

Surprisingly, the applicant has found that optimum results are achievable, in terms of preventing an undesirable release of ink, by adopting a silicone material as the first elastically deformable material.

For such optimum results to be achieved, moreover, the applicant has found that the silicone material must have a high percentage elongation at rupture. The optimum elongation in question is between 300% and 800%, preferably between 450% and 700%, and yet more preferably, 590% or thereabouts.

The applicant has also found that the optimum silicone material has an ultimate tensile strength of between 3.5 and 11 N/mm2, preferably between 5 and 7 N/mm2, and yet more preferably, 5.8 N/mm2 or thereabouts.

Furthermore, the applicant has found that the optimum silicone material presents a Shore A hardness of between 10 and 40, preferably between 20 and 30, and yet more preferably, 25 or thereabouts.

Table 1 below indicates the main mechanical parameters of certain silicone materials (silicone rubbers) that have proven capable of delivering optimum performance in terms of preventing an undesirable release of ink from the cartridge.

TABLE 1

| | S1 | S2 | S3 |
|---|---|---|---|
| Hardness (Shore A) | 20 | 30 | 25 |
| Density (g/cm3) | 1.10 | 1.13 | 1.07 |
| Ultimate tensile strength (N/mm2) | 8.2 | 7.7 | 5.8 |
| Elongation at rupture (%) | 810 | 640 | 590 |

In order to minimize the difference in pressure levels inside and outside of the cartridge 8, it is preferable that the silicone material used for the cartridge 8 should be highly permeable to gases.

To advantage, as illustrated in FIG. 1, the cartridge 8 further comprises at least one second portion 11 (two portions 11 according to FIG. 1 defining the longitudinal end of the cartridge 8) fashioned from a second material less deformable than the first material.

The second material is preferably a rigid plastic, and yet more preferably, polycarbonate, or polyamide, or polybutylene terephthalate (PBT).

The second material, which is therefore substantially stiff when compared to the more readily deformable silicone material, serves to provide the cartridge 8 with a rigid frame, that is to say a strong and stable outer structure such as will give the cartridge 8 a substantially permanent outer shape.

In other words, the cartridge 8 comprises at least one substantially rigid portion 11, and at least one portion 10 that is elastically deformable relative to the rigid portion 11, in order to produce the aforementioned deformed configuration.

In a preferred embodiment of the invention, illustrated in FIGS. 3 and 3.1, the cartridge 8 comprises a main frame fashioned from the aforementioned second plastic material and presents one or more windows or apertures F, provided with a covering made of the first silicone material.

With this arrangement, it is the aforementioned windows F that allow the cartridge 8 to expand and increase its containment volume.

Preferably, each window F extends parallel with a longitudinal axis Y of the cartridge 8 (coinciding with the longitudinal axis X of the barrel 2).

Also, the windows F are arranged in succession on a developable plane completely encircling the longitudinal axis Y.

In one possible embodiment of the invention, the cartridge 8 is furnished with one or more leaves (or membranes) of silicone material, each covering a respective window F.

In an alternative embodiment, the cartridge 8 is furnished with a single membrane of silicone material, attaching the selfsame silicone membrane to the frame fashioned from the second plastic material in such a manner that different parts of the membrane are positioned to cover respective windows F of the cartridge 8.

In FIG. 3, the first material is denoted M1 and the second material is denoted M2.

From a constructional standpoint, the applicant has found unexpectedly that the geometrical parameter having the greatest influence on the performance of the cartridge, in terms of preventing the release of ink, is the thickness of the first material.

In particular, optimum thickness values for the silicone material (the areas covering the windows F of the cartridge 8) are between 0.15 and 0.45 millimeters, and preferably between 0.2 and 0.3 millimeters. The best performance characteristics are obtained with a constant thickness of 0.25 millimeters or thereabouts.

The thickness of the silicone material can be constant or variable, but will fall preferably within the ranges of values indicated above.

Adopting a preferred method of manufacture, moreover, the cartridge 8 can be fashioned by co-moulding the silicone material of the first portion 10 together with the plastic material of the second portion 11.

In combination with the cartridge 8 presenting the features described above, the fountain pen 1 also comprises valve means 12 designed to enable and to regulate the flow of ink passing from the reservoir S to the nib 4 via the feed element 5 and that in case of variations of the atmospheric pressure interact with the cartridge to avoid any undesired expulsion of ink.

Figure 4:
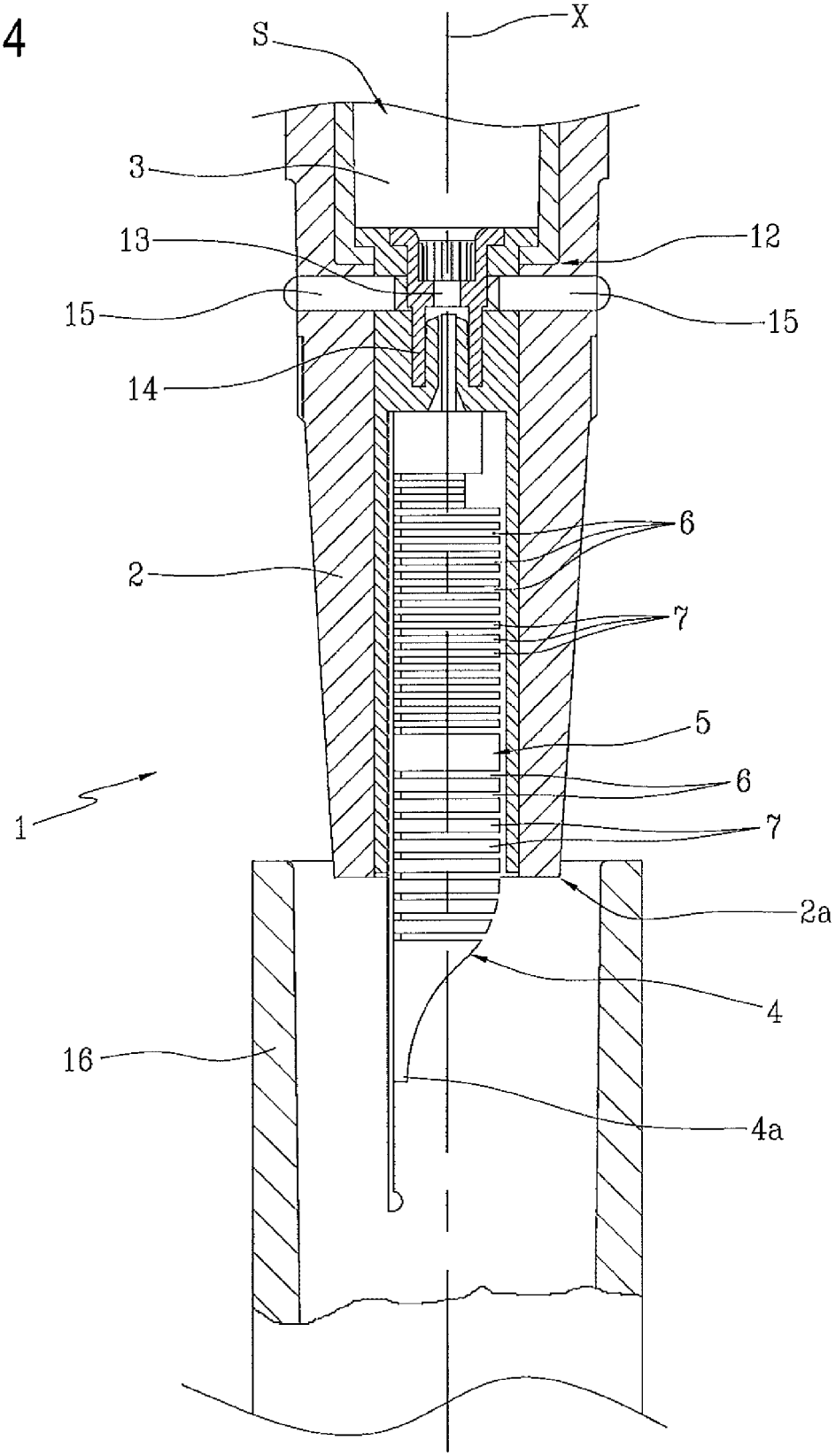
FIG. 4 shows the portion of the fountain pen in FIG. 1, seen in a sectional view taken on a longitudinal plane, illustrated in a different embodiment and in a first operating configuration.
Figure 5:
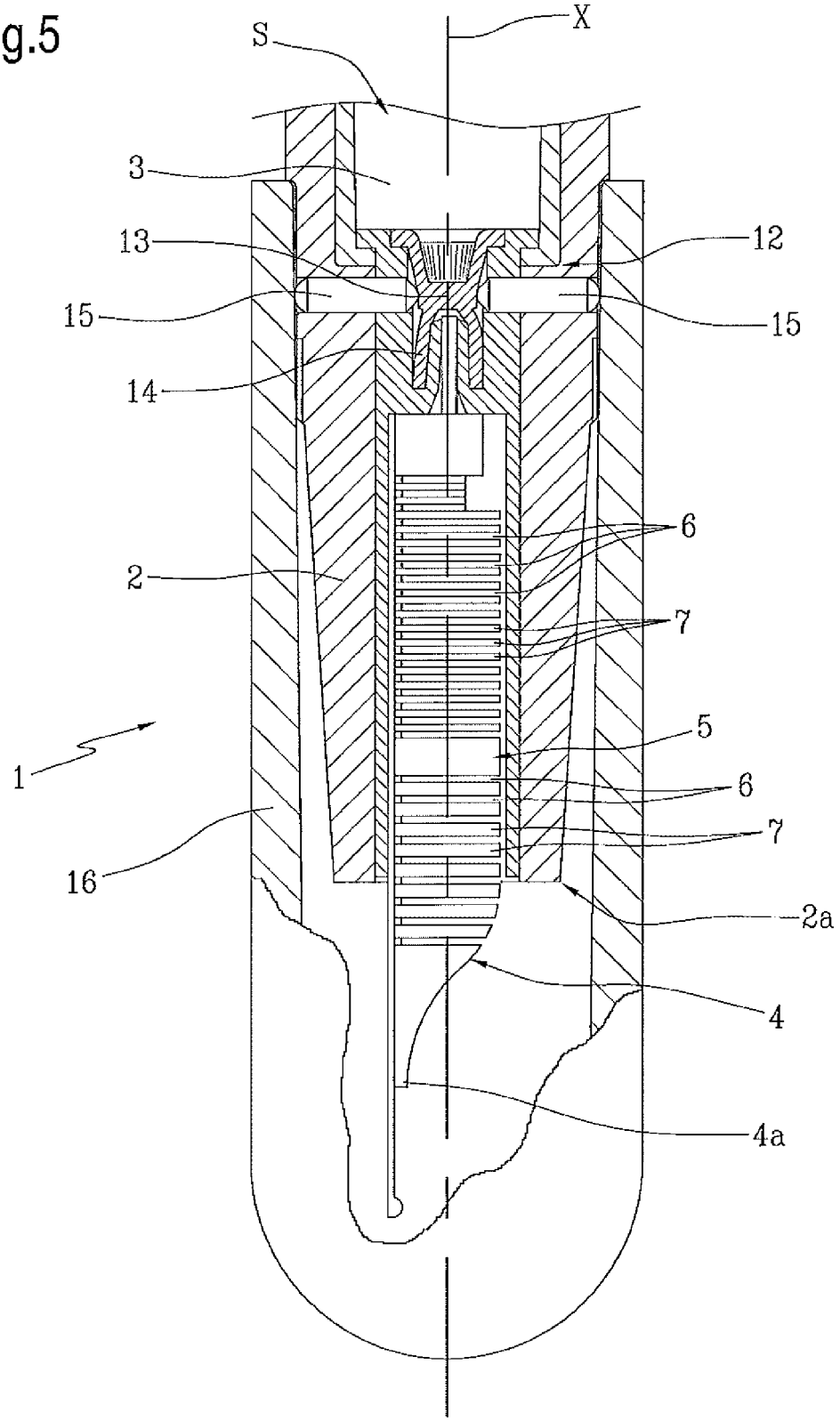
FIG. 5 shows the portion of the fountain pen in FIG. 4, seen in a sectional view taken on a longitudinal plane and illustrated in a second operating configuration.

More exactly, as illustrated in FIGS. 4 and 5, the pen 1 comprises a connecting duct 13 interposed between the reservoir S and the nib 4, serving to place the reservoir S and the nib 4 in fluid communication one with another by way of the feed element 5.

The valve means 12 are designed to operate on the connecting duct 13, alternating between an open configuration (FIG. 4) in which ink is able to flow through the connecting duct 13, and a closed configuration (FIG. 5) in which the flow of ink through the connecting duct 13 is cut off.

Figure 6A:
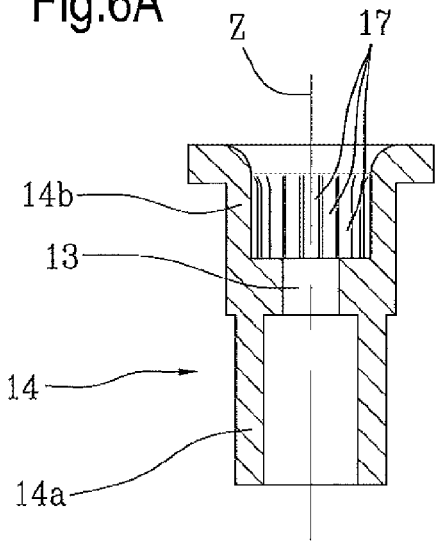
FIG. 6A shows a detail of the fountain pen in FIG. 5, seen in a sectional view taken on a longitudinal plane and illustrated in a first operating configuration.

The valve means 12 in question comprise a connecting element 14 located between the reservoir S and the nib 4 and designed to incorporate the connecting duct 13 internally, as illustrated in FIG. 6A.

Figure 6B:
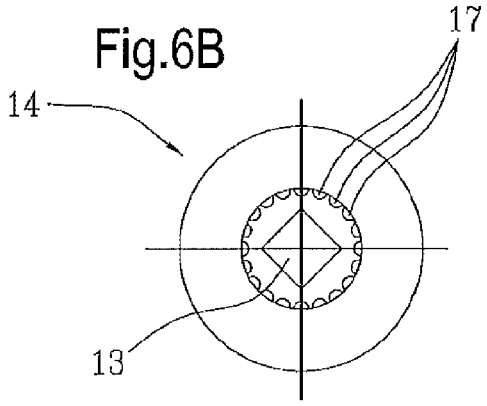
FIGS. 6B and 6C show the detail of FIG. 6A in views from above and beneath, respectively, illustrated in the first operating configuration.
Figure 6C:
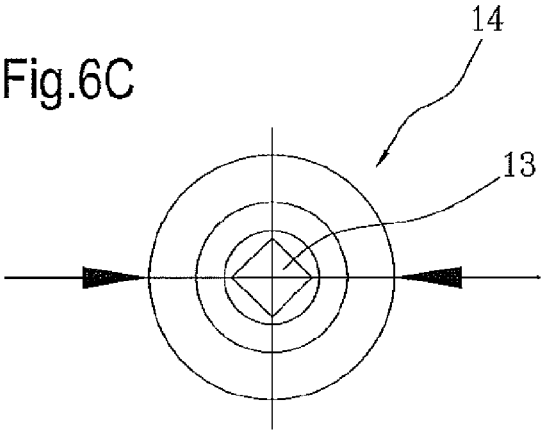

Advantageously, the connecting duct 13 presents a cross section of polygonal, preferably quadrangular, and yet more preferably, rectangular or square geometry (FIGS. 6B and 6C).

The polygonal section presents a profile appearing as a succession of consecutive segments and serves to break the surface tension of the ink, which consequently will run more freely and encounter less flow resistance than would be the case, for example, with a duct of perfectly round section. The polygonal section thus prevents the creation of surface tension that would cause deposits to form on the connecting element 14 and impede the correct flow of the ink.

Advantageously, the connecting element 14 is fashioned from a deformable material, preferably silicone, and able to alternate between a normally undeformed configuration coinciding with an open configuration of the valve means 12, and a deformed configuration coinciding with a closed configuration of the valve means 12.

The deformability of the connecting element 14 is elastic in nature. Accordingly, once the connecting element 14 has assumed the deformed configuration, it will tend to return to the initial undeformed configuration spontaneously.

The polygonal geometry (hence also rectangular or square geometry) of the connecting duct 13 is established when the connecting element 14 presents the normally undeformed configuration 14.

The valve means 12 also comprise at least one presser element 15, associated slidably with the barrel 2 of the pen 1, capable of shifting toward and away from the connecting element 14 and causing the selfsame element 14 to assume the aforementioned deformed and undeformed configurations.

The presser element 15 is fashioned preferably as a pin, or plunger, seated slidably in a hole afforded by the barrel 2 of the pen 1.

To advantage, the presser element 15 impinges on a vertex of the polygonal section presented by the connecting duct 13 in such a way as to direct this same vertex toward another (non-adjacent) vertex of the polygonal section.

Where the connecting duct 13 is of quadrangular section, the presser element 15 causes one vertex to draw close to or enter into contact with the opposite vertex.

Under the forcing action of the presser element 15, the quadrangular section is deformed to the point of assuming the shape of a much compressed rhomboid, or preferably collapsed to the point of appearing substantially as a segment (completely blocking the flow of ink).

This complete closure would be difficult if not impossible to achieve, were the forcing action to be applied at intermediate points on the segments making up the polygonal section.

Figure 7:
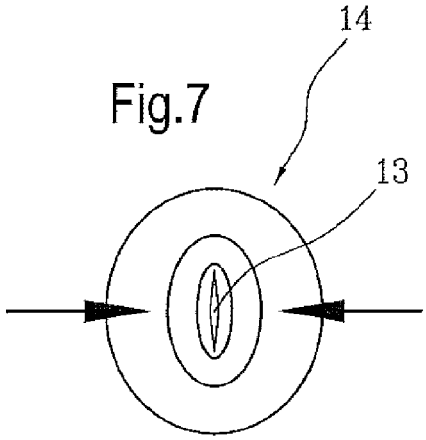
FIG. 7 shows the detail of FIG. 6A in a view from beneath, illustrated in a second operating configuration.

Adopting the preferred embodiment of FIGS. 4 and 5, the valve means 12 comprise two mutually opposed presser elements 15 acting on two opposite (or at least non-adjacent) vertices of the polygonal section, such as will deform the connecting element 14 to the point of bringing these same two vertices into close proximity or direct contact one with another, blocking the flow of ink completely (FIG. 7).

Where the connecting duct 13 is of quadrangular section, the two presser elements 15 impinge on mutually opposed vertices of the polygonal section.

In FIGS. 6C and 7, the arrows indicate the direction of the pushing force exerted by the presser elements 15 on the connecting element 14.

The valve means 12 are subject to the action of the removable cap 16 of the pen fitted to the barrel 2 in such a way as to cover the nib, preferably ensuring a hermetic closure.

The valve means 12 are activated directly by the cap 16 in such a way as to disallow the passage of ink from the reservoir S to the nib when the cap is fitted to the barrel.

In particular, the presser elements 15 are operated directly by the cap 16 when fitted over the nib 4. More exactly, the presser elements 15 will be engaged by the cap 16 and forced toward one another, ultimately deforming the connecting element 14 and cutting off the fluid communication between the reservoir S and the nib 4.

When the cap 16 is removed subsequently, the presser elements 15 are released and tend to move away from one another, forced apart by the connecting element 14 as it returns elastically to its initial shape, and fluid communication between the reservoir S and the nib 4 is restored.

To avoid to modify the flow condition of the ink from the reservoir S to the nib 4 and to avoid any modification of the pressure condition of the said flow, the connecting element 14 presents a preferably axial-symmetric, and more preferably a circular outer structure, aligned concentrically on a respective axis Z coinciding with the longitudinal axis X of the barrel 2.

Preferably, as illustrated in FIG. 6A, the connecting element 14 presents a lateral profile substantially of "T" shape, or rather, comprising a lower portion 14*a* of smaller section and a longitudinally adjoining portion 14*b* of larger section, which combine to give the connecting element 14 the aforementioned "T" profile.

The portion 14*b* of larger section presented by the connecting element might also incorporate a part of the connecting duct 13 that is widened, relative to the part of the connecting duct 13 presented by the portion 14*a* of smaller section.

To advantage, as illustrated in FIG. 6B, the connecting element 14 might present a plurality of ribs 17 internally of the connecting duct 13, providing the wall of the selfsame duct 13 with an irregular surface that serves to break the surface tension of the ink flowing through the duct and consequently facilitate its passage.

The ribs 17 extend parallel to the longitudinal axis Z of the connecting element 14, projecting radially into the connecting duct 13 (directed away from the wall of the connecting duct 13 and toward the longitudinal axis Z of the connecting element 14), and are distributed angularly around the selfsame longitudinal axis Z.

The ribs 17 will be located preferably in the part of the connecting duct 13 that occupies the portion 14*b* of larger section presented by the connecting element 14.

Moreover, the ribs 17 are located at the end of the connecting element 14 directed toward the cartridge 8.

In addition, the part of the connecting duct 13 furnished with the aforementioned ribs 17 will preferably be wider in section than the part of the connecting duct 13 engaged by the presser elements 15.

The drawbacks associated with the prior art are overcome by the present invention, and the stated objects duly realized.

The use of a deformable and dilatable cartridge according to the invention, as described above, enables the ink reservoir of a fountain pen to absorb possible pressure jumps (caused by fluctuations in pressure and/or temperature) without any leakage of ink occurring. In the eventuality of such a pressure jump, more exactly, the cartridge is readily deformable and will expand, its containment volume increasing to accommodate the sudden change in pressure and limit the tendency for the ink to be forced from the cartridge.

In combination with the action of the ink feed element, this expansion has the effect of negating the risk of leaks from the nib, since any minimal leakages of ink from the cartridge will be taken up and held by the retaining chambers of the feed element.

The invention claimed is:

1. A fountain pen, comprising:

a hollow barrel such as can be held by a user;

a nib stably attached to one end of the hollow barrel;

an ink reservoir having a given containment volume, housed internally of the hollow barrel and connected to the nib by a feed element such that ink can be supplied through the feed element to the nib;

wherein the reservoir is deformable between a normally undeformed first configuration, and a deformed second configuration in which the containment volume of the reservoir is greater than the containment volume in the undeformed configuration;

wherein the reservoir comprises a cartridge;

wherein the cartridge includes a first portion fashioned from a first elastically deformable material, thereby enabling elastic deformation between the undeformed configuration and the deformed configuration;

wherein the cartridge further comprises a second portion fashioned from a plastic second material less deformable than the first material, providing a frame for the cartridge.

2. The fountain pen as in claim 1, wherein the cartridge is centered on a longitudinal axis, and the transition from the undeformed configuration to the deformed configuration occurs as a result of the cartridge expanding in a direction away from the longitudinal axis.

3. The fountain pen as in claim 1, wherein the cartridge is accommodated internally of the hollow barrel to create an annular air chamber between the cartridge and the barrel, of width measuring between 0.5 and 3 millimeters, thereby allowing the cartridge to deform by expansion.

4. The fountain pen as in claim 1, wherein the first material is a silicone material.

5. The fountain pen as in claim 4, wherein the silicone material has a percentage elongation at rupture of between 500% and 800%.

6. The fountain pen as in claim 4, wherein the silicone material has a hardness of between 10 and 40 Shore A.

7. The fountain pen as in claim 4, wherein the silicone material has an ultimate tensile strength of between 3.5 and 10 N/mm2.

8. The fountain pen as in claim 4, wherein the thickness of the first portion is between 0.15 and 0.45 millimeters.

9. The fountain pen as in claim 4, wherein the plastic second material is at least one chosen from polycarbonate, or polyimide, or polybutylene terephthalate (PBT).

10. The fountain pen as in claim 4, wherein the cartridge is centered on a respective longitudinal axis, and the transition from the undeformed configuration to the deformed configuration consists in an expanding movement of the first portion away from the longitudinal axis.

11. The fountain pen as in claim 4, further comprising an ink feed element positioned between the reservoir and a writing tip of the nib, serving to regulate a flow of ink supplied to the tip of the nib, wherein the feed element includes a plurality of retaining chambers designed to fill with ink released from the reservoir in an event of the flow delivered to the nib being excessive.

12. The fountain pen as in claim 4, further comprising a removable cap serving to cover the nib, and a valve located between the reservoir and the nib such as will selectively cut off the flow of ink from the reservoir to the nib, wherein the valve is activated by the cap in such a way that the flow of ink from the reservoir to the nib will be cut off when the cap is fitted over the nib.

13. The fountain pen as in claim 1, wherein the second portion includes an aperture, and the first portion comprises a deformable covering membrane fashioned from the first material and positioned to close the aperture.

14. The fountain pen as in claim 1, wherein the second portion includes a plurality of apertures, and the first portion comprises a plurality of deformable covering membranes fashioned from the first material, each positioned to close a respective aperture.

15. The fountain pen as in claim 1, wherein the second portion includes a plurality of apertures, and the first portion comprises a single deformable covering membrane fashioned from the first material and applied to the second portion to close all of the apertures.

16. A fountain pen, comprising:

a hollow barrel such as can be held by a user;

a nib stably attached to one end of the hollow barrel;

an ink reservoir housed internally of the hollow barrel, from which ink is supplied to the nib, the reservoir being deformable between a normally undeformed first configuration, and a deformed second configuration in which the containment volume of the reservoir is greater than the containment volume in the undeformed configuration;

a connecting duct of polygonal section, interposed between the reservoir and the nib to place the reservoir and the nib in fluid communication one with another;

a valve operating on the connecting duct to allow and regulate passage of ink through the connecting duct;

wherein the valve operates on the connecting duct, assuming at least an open configuration, in which the passage of ink through the connecting duct is allowed, and a closed configuration in which the passage of ink through the connecting duct is disallowed;

wherein the valve comprises a deformable connecting element that incorporates the connecting duct internally and is deformable between a normally undeformed configuration, coinciding with the open configuration of the valve, and a deformed configuration coinciding with the closed configuration of the valve;

wherein the connecting element includes a plurality of ribs internally of the connecting duct, extending parallel to a longitudinal axis of the connecting element and distributed angularly around the longitudinal axis of the element, which provide a wall of the duct with an irregular surface.

17. The fountain pen as in claim 16, further comprising a cap such as can be associated removably with the barrel to cover the nib, the valve being activated by the cap to disallow the passage of ink from the reservoir to the nib when the cap is fitted over the nib.

18. The fountain pen as in claim 17, wherein the valve comprises a presser element, associated slidably with the barrel in such a way as to shift toward and away from the connecting element and cause the element to alternate between the deformed and undeformed configurations, the presser element impinging on a vertex of the polygonal section presented by the connecting duct and operated by the cap to cause the connecting element to assume the deformed configuration when the cap is fitted over the nib.

19. The fountain pen as in claim 17, wherein the valve comprises a pair of presser elements, associated slidably with the barrel in such a way as to shift toward and away from the connecting element and cause the element to alternate between the deformed and undeformed configurations, the presser elements impinging on respective non-adjacent vertices of the polygonal section presented by the connecting duct and operated by the cap to cause the connecting element to assume the deformed configuration when the cap is fitted over the nib.

20. The fountain pen as in claim 16, wherein the connecting duct, in the undeformed configuration, includes a quadrangular cross section.

21. The fountain pen as in claim 20, wherein the presser elements impinge on opposite vertices of the quadrangular cross section.

* * * * *